United States Patent [19]

Ueda et al.

[11] Patent Number: 5,019,316

[45] Date of Patent: May 28, 1991

[54] METHOD FOR PRODUCING THERMOPLASTIC SYNTHETIC YARN

[75] Inventors: Kunihiko Ueda, Otsu; Katsumi Hasegawa, Kusatsu; Nobuyuki Kuriyama, Otsu, all of Japan

[73] Assignee: Toray Industries, Inc., Tokyo, Japan

[21] Appl. No.: 383,434

[22] Filed: Jul. 24, 1989

Related U.S. Application Data

[62] Division of Ser. No. 69,703, Jul. 2, 1987, abandoned.

[30] Foreign Application Priority Data

Jul. 3, 1986 [JP] Japan ..... 61-157039

[51] Int. Cl.[5] ..... D01D 5/088; D01D 5/14

[52] U.S. Cl. ..... 264/178 F; 264/180; 264/181; 264/210.2; 264/210.8; 264/210.7; 264/211.15; 264/211.17

[58] Field of Search ..... 264/178 F, 180, 203, 264/210.8, 210.2, 210.7, 211.5, 211.7; 425/66–69, 71, 72.2

[56] References Cited

U.S. PATENT DOCUMENTS

| | | | |
|---|---|---|---|
| 3,002,804 | 10/1961 | Kilian | 264/181 |
| 3,084,991 | 4/1963 | Garty et al. | 18/54 |
| 3,126,434 | 3/1964 | Berger, Jr. | 264/178 F |
| 3,221,088 | 11/1965 | Martin et al. | 264/181 |
| 3,412,191 | 11/1968 | Kitajima et al. | 264/181 |
| 3,422,171 | 1/1969 | Oppenlander | 264/210 B |
| 3,452,132 | 6/1969 | Pitzl | 264/210.8 |
| 3,488,344 | 1/1970 | Biffi et al. | 264/181 |
| 3,996,321 | 12/1976 | Weinberger | 264/181 |
| 4,070,431 | 1/1978 | Lewis et al. | 264/180 |
| 4,098,864 | 7/1978 | Morris et al. | 269/289.3 |
| 4,451,422 | 5/1984 | Yui et al. | 264/178 F |
| 4,456,575 | 6/1984 | Smith et al. | 264/234 |
| 4,702,871 | 10/1987 | Hasegawa et al. | 264/101 |
| 4,863,662 | 9/1989 | Hasegawa et al. | 264/178 F |

FOREIGN PATENT DOCUMENTS

| | | |
|---|---|---|
| 0147173 | 7/1985 | European Pat. Off. . |
| 4326326 | 11/1943 | Japan . |
| 4326331 | 11/1943 | Japan . |
| 35-2721 | 3/1960 | Japan . |
| 35-3104 | 4/1960 | Japan . |
| 38-2016 | 3/1963 | Japan . |
| 45-1932 | 1/1970 | Japan . |
| 56-140117 | 11/1981 | Japan . |
| 58-16913 | 12/1983 | Japan . |
| 61-28011 | 2/1986 | Japan . |
| 803237 | 10/1958 | United Kingdom . |
| 82886 | 2/1960 | United Kingdom . |
| 908409 | 10/1962 | United Kingdom . |
| 1034401 | 6/1966 | United Kingdom . |
| 1043236 | 9/1966 | United Kingdom . |
| 10811379 | 8/1967 | United Kingdom . |
| 1478787 | 7/1977 | United Kingdom . |

*Primary Examiner*—Hubert C. Lorin

*Attorney, Agent, or Firm*—Birch, Stewart, Kolasch & Birch

[57] ABSTRACT

A system for producing a drawn yarn having a durable mechanical and thermal stability in practical use from a fiber-forming polymer by means of a single continuous process is disclosed. A yarn extruded from a spinneret is first introduced into a liquid bath for cooling and subsequently to a hot chamber filled with a pressurized steam for heat-treatment, in which the yarn is drawn against a resistance caused by the liquid bath. The vessel of the liquid bath is provided with a yarn exit path adapted to allow the passage of the yarn but inhibit the leakage of the liquid and to remove a concomitant liquid from the yarn. The hot chamber is provided with inlet and outlet paths for the yarn also adapted to allow the passage of the yarn but inhibit the leakage of the steam. The system is suitable for producing for industrial use a yarn composed of thicker individual filaments.

15 Claims, 4 Drawing Sheets

METHOD FOR PRODUCING THERMOPLASTIC SYNTHETIC YARN

This application is a divisional of copending application Ser. No. 07/069,703, filed July 2, 1987, now abandoned.

BACKGROUND OF THE INVENTION

1. Field of the Invention

The present invention relates to a system for melt-spinning a synthetic yarn from a thermoplastic polymer, and more particularly, to a method and an apparatus for obtaining such a yarn having a durable mechanical and thermal stability in practical use, at a low manufacturing cost, by only a single continuous process. This system is suitable for producing for industrial use a yarn composed of thicker individual filaments.

2. Description of the Prior Art

In the conventional method, a thermoplastic polymer is melted, spun from a spinneret, cooled and solidified, and continuously taken up as a package of an undrawn yarn having a low molecular orientation. Thereafter, the undrawn yarn is drawn while heated, by a separate process, to obtain a drawn yarn having a durable mechanical stability in practical use.

Recently, to reduce costs and save energy, many attempts have been made to produce a drawn yarn through a single continuous process following the melt-spinning of the polymer from a spinneret.

A direct spinning system is one such attempt, in which a melt-spinning step is directly connected to a drawing step so that an undrawn yarn spun from a spinneret is continuously introduced, without being taken up as a package, to a group of hot rollers for drawing. This system, however, has a drawback of a high energy consumption because the hot rollers must rotate at a high speed.

Japanese Examined Patent Publication (Kokoku) No. 35-3104 discloses that a fiber durable for practical use can be obtained by taking up a yarn spun from a spinneret at a high speed. This method, however, requires an expensive, high speed winder, and in addition, it is difficult to maintain a stable operation by avoiding the many filament breakages occurring in the yarn thus produced.

Japanese Examined Patent Publication (Kokoku) No. 45-1932 proposed a method for producing a drawn yarn, comprising the steps of melt-spinning a thermoplastic polymer, cooling the yarn thus obtained, running the yarn through a hot zone maintained at a temperature above 80° C., and taking up the heat-treated yarn at a speed higher than 4000 m/min. Although a yarn can be produced at a lower cost according to this method, the mechanical properties thereof are still inferior to those of the conventional drawn yarn. In addition, a high speed take-up at above 4000 m/min causes similar defects to those of the above prior art procedures.

A method for obtaining a drawn yarn by running an as-spun yarn through a liquid bath is proposed, for example, in Japanese Examined Patent Publication (Kokoku) No. 35-2721 (corresponding to U.K. Patent No. 803237), Japanese Examined Patent Publication (Kokoku) No. 38-2016 (corresponding to U.K. Patent No. 828986) and Japanese Unexamined Patent Publication (Kokai) No. 58-169513. According to this method, due to a viscous resistance of liquid bath the yarn can be drawn to form a drawn yarn with less elongation. The strength of the yarn, however, is reduced due to a shock exerted thereon when drawn by the resistance of the liquid bath, and further the yarn has an inferior thermal stability, i.e., has a high thermal shrinkage rate in both its dry and wet conditions.

SUMMARY OF THE INVENTION

Therefore, an object of the present invention is to solve the above drawbacks of the prior art.

Another object of the present invention to provide a system for producing, at a reduced manufacturing cost and under stable conditions, a thermoplastic yarn having an excellent mechanical and thermal stability.

These objects can be achieved by a method for producing a thermoplastic synthetic yarn, comprising the steps of continuously extruding a fiber-forming thermoplastic polymer in a molten state downward from a spinneret to form a filament, cooling the as-spun yarn, and continuously taking up the cooled yarn, wherein the cooling step is carried out by passing the as-spun yarn downward through a liquid bath disposed beneath the spinneret, and the taking-up step is carried out after the cooled yarn is heat-treated by passage through a hot chamber filled with a pressurized steam. The chamber is provided with narrow inlet and outlet paths having a size which allows the yarn to pass therethrough but substantially prevents the pressurized steam from escaping from the chamber.

According to the present invention, it is essential to extrude a thermoplastic polymer in a molten state from a spinneret to form a yarn, and to run the yarn along a substantially rectilinear passage through a liquid bath disposed beneath the spinneret. To obtain a drawn yarn having good mechanical properties, according to the present inventors' research, it has been found that it is effective to elevate stress in the processed yarn against a take-up tension after the as-spun yarn has been cooled and solidified.

To realize the above favorable conditions, in the conventional method, a running yarn is braked by being wound around a yarn guide after being cooled and solidified by the application of a cooling air. This proposal may be effective for the elevation of an internal stress of the yarn, but causes serious defects in that an individual filament composing the yarn is damaged due to abrasion with the yarn guide, resulting in many fluffs in the resultant yarn. This tendency is more significant when the individual filament is relatively coarse and is difficult to sufficiently cool to a low temperature, because the yarn is liable to adhere to the yarn guide under such conditions.

Contrary to this, according to the present invention, the as-spun yarn is effectively cooled by a liquid bath, in which at the same time an internal stress is increased in the yarn against a drawing force due to a viscosity of the liquid, and thus a uniform drawing can be obtained. In this process, it is important to run the yarn through the liquid bath along a substantially straight passage, whereby a drawn yarn having no thickness unevenness between the respective filaments is obtained.

According to the present invention, it is essential to fluidly seal a yarn exit path of the liquid bath. A yarn running speed at a spinning stage reaches several thousands m/min, and accordingly, much liquid accompanies the yarn withdrawn from the liquid bath, which liquid tends to contaminate the environmental conditions of the process and interferes with the subsequent heat treatment of the yarn. The sealing of the yarn exit path of the liquid bath is intended to minimize the quantity of liquid accompanying the withdrawn yarn.

It is also essential that the yarn withdrawn from the liquid bath be introduced into a hot chamber filled with a pressurized steam having a pressure higher than that of the outer air. According to the present inventors' research, it has been found that, although the yarn may be drawn in the liquid bath due to the resistance caused by a liquid viscosity, the drawn yarn generally has an inferior strength due to violent deformation thereof and in addition is thermally unstable.

The present inventors have found that the most effective way to improve the yarn qualities is to run the yarn withdrawn from the liquid bath through the hot chamber filled with pressurized steam having a pressure higher than that of the outer air Inlet and outlet paths for the yarn are provided at opposite ends of the hot chamber, and prevent the steam from escaping from the chamber. Although the yarn exit path of the liquid bath is effectively sealed as described above, a small amount of liquid escapes through the yarn exit path while adhering to the yarn body. This adhered liquid is often introduced into the hot chamber together with concomitant air. The sealing of the inlet and outlet paths of the hot chamber is intended to minimize the introduction of the concomitant flow into the hot chamber and the leakage of the steam from the interior thereof, so that pressurized steam having a pressure higher than the outer air is always present therein and thus the yarn can be given a uniform heat treatment.

As stated above, it is possible to produce, at a reduced manufacturing cost, a yarn having excellent mechanical properties and thermal stability by only a single continuous process starting from the meltspinning of a thermoplastic polymer from a spinneret, in which the yarn as spun from the spinneret is passed through a liquid bath disposed beneath the spinneret along a substantially straight passage for cooling, and the cooled yarn is withdrawn from the liquid bath through a fluidly sealed yarn exit path and introduced into a hot chamber filled with pressurized steam and having inlet and outlet paths at opposite ends which paths allow the yarn to pass but inhibit any escape of the steam therethrough, prior to taking up the yarn as a yarn package.

According to another aspect of the present invention, an apparatus suitable for carrying out the above method of producing a thermoplastic yarn is provided.

DESCRIPTION OF THE DRAWINGS

The present invention will be described in more detail with reference to the preferred embodiments illustrated in the following drawings, wherein.

DESCRIPTION OF THE PREFERRED EMBODIMENTS

Figure 1:
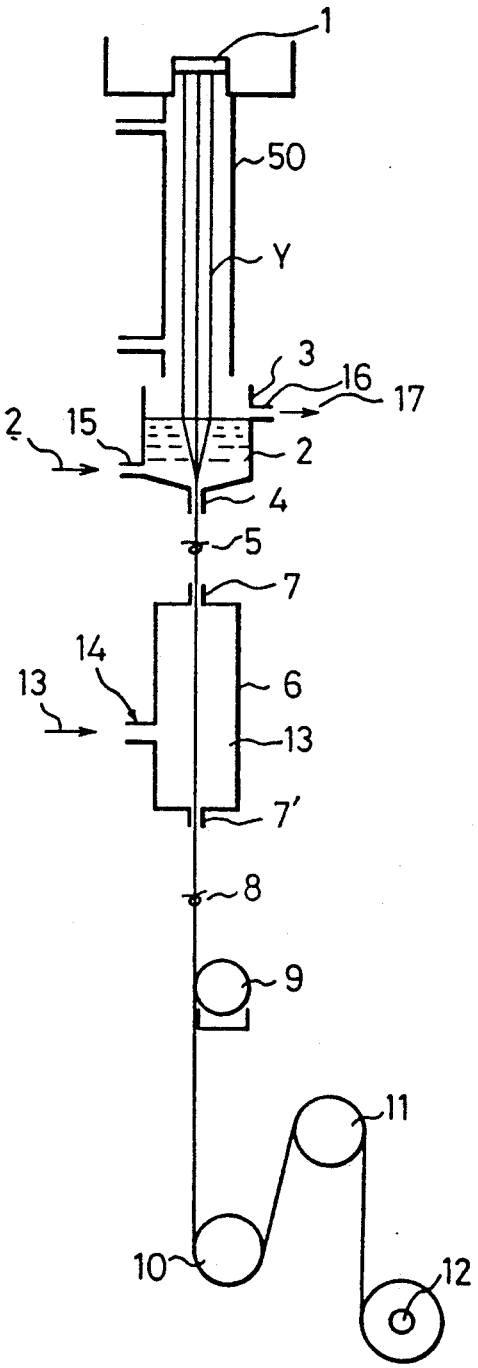
FIG. 1 is a diagramatic side view of a representative embodiment of a process according to the present invention.

With reference to FIG. 1, a yarn Y melt-spun from a spinneret 1 is introduced into a liquid bath 2 contained in a vessel 3 disposed beneath a spinning conduit 50, such as a conventional cooling chimney and/or a spinning duct, for preliminarily quenching the as-spun yarn prior to introduction to the liquid bath. The yarn thus cooled and solidified is withdrawn from the vessel 3 through a yarn exit path 4 provided in the bottom thereof. The yarn exit path 4 has a small inner size sufficient to prevent the liquid contained in the vessel 3 from escaping therethrough but allowing the yarn to pass therethrough. The yarn is then rushed into the interior of a hot chamber 6 via a yarn guide 5 for heat-treatment Thereafter, the heat-treated yarn is withdrawn therefrom via another yarn guide 8 and taken up on a winder 12 via a pair of take-up rollers 10, 11, after being oiled by an oiling device 9.

Figure 2:
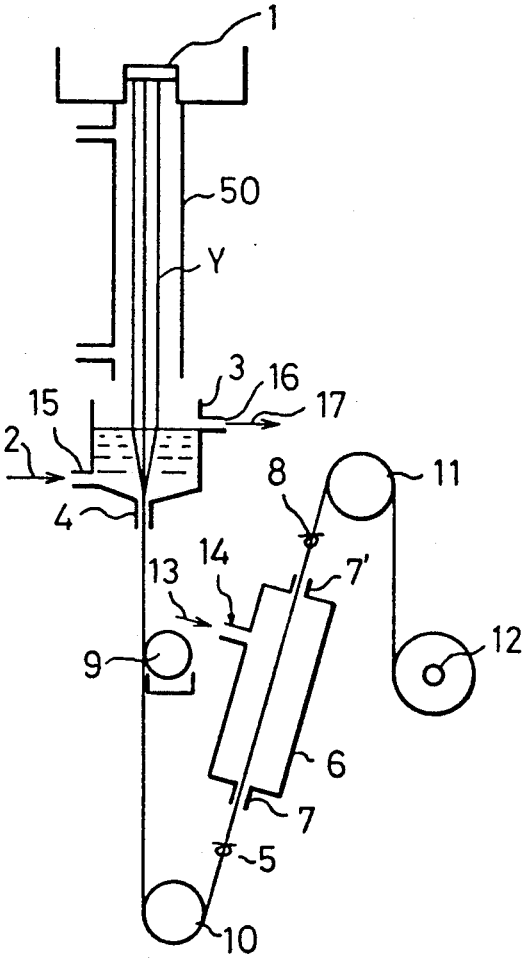
FIG. 2 is a similar view of another embodiment of a process according to the present invention.

The oiling device 9 may be disposed upstream of the hot chamber 6 and, in turn, the hot chamber 6 may be disposed between the take-up rollers 10 and 11, as shown in FIG. 2. According to the latter arrangement, yarn tension during the heat-treatment in the hot chamber 6 can be optionally adjusted by varying the relative speed between the rollers 10 and 11.

The hot chamber 6 is provided with inlet and outlet paths 7 and 7' having a narrow inner size for allowing the yarn to pass therethrough at the opposite ends of the hot chamber 6. Pressurized steam 13 is filled within the interior of the hot chamber 6 through a supply pipe 14 for heat-treatment of the yarn. The hot chamber 6 may be of a tubular form having a circular or rectangular cross-section, or another cross-section, provided the pressurized steam can be effectively accommodated therein. In addition, a tape heater (not shown) may be wound around the periphery of the hot chamber 6 to minimize the amount of drain generated at the initial stage of the operation and to reduce the temperature difference between the respective spinning units. Further, preferably the hot chamber 6 is encircled by a thermal insulating member (not shown) to minimize heat radiation therefrom.

A liquid 2, preferably water, is supplied from a liquid supply pipe 15 to the vessel 3, in which the height of the liquid surface is maintained at a predetermined level while the excess liquid 17 is discharged from an overflow tube 16. In this connection, a temperature of the liquid bath is preferably within a range of from 5° C. to 90° C., and the time required for passage of the yarn through the liquid bath is preferably within a range of from 0.001 seconds to 0.15 seconds.

The vessel 3 has a narrow yarn exit path 4 at the bottom thereof to minimize the amount of liquid discharged through the yarn exit path 4 while concomitant with the withdrawn yarn. If the sealing of the yarn exit path 4 is insufficient, the liquid concomitant with the yarn becomes excessive, which causes an irregular and/or insufficient heat-treatment of the yarn in the hot chamber 6, as well as of the environmental conditions.

Figure 3:
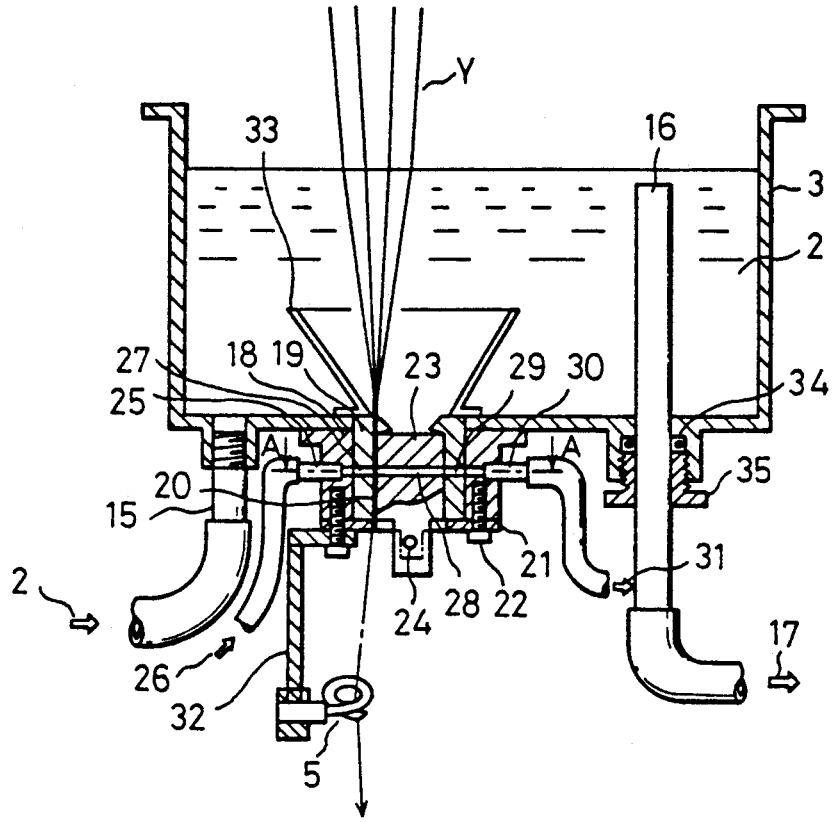
FIG. 3 is a side sectional view of a liquid vessel suitably utilized for the process according to the present invention.
Figure 4:
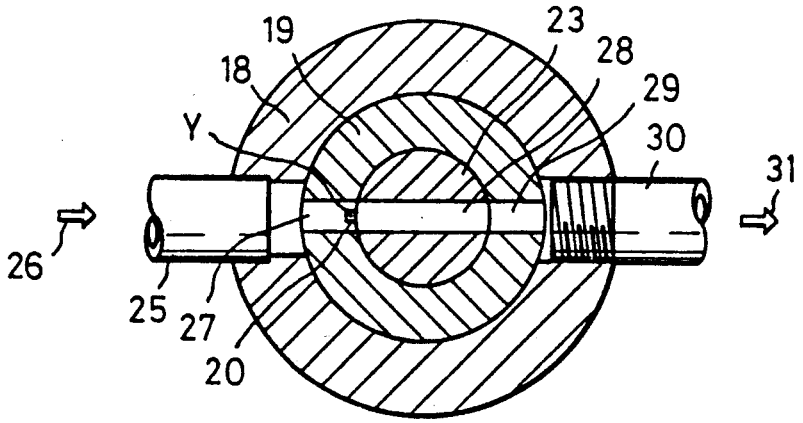
FIG. 4 is a cross-section taken along the line A—A in FIG. 3.

FIG. 3 illustrates one of the preferred embodiments of the vessel utilized for the present invention, and FIG. 4 is a cross-section taken along to line A—A in FIG. 3. A tubular housing 18 is secured to the bottom of the vessel 3 by a screw (not shown). A cylindrical sleeve 19 having a narrow slit 20 in the inner surface allowing the yarn to pass therethrough is detachably inserted in the housing 18, and fixed to the housing 18 by another screw 22 and a flange 21. A column-like plug 23 is detachably inserted in the sleeve 19 and fixed to the flange 21 by a pin 24. According to the above structure, the slit 20 forms a sealed yarn exit path 4. If the width and the length of the slit 20 is selected to be of a smaller size sufficient to allow the yarn to pass but inhibiting the escape of the liquid therethrough, leakage of the liquid from the vessel can be effectively stopped due to a head loss in the slit zone.

To further reduce the leakage of the liquid from the yarn exit path while concomitant with the yarn Y, pressurized air 26 is introduced into a first conduit 25 and ejected from an aperture 27 at a point midway in the slit 20 in the direction transverse to the yarn exit path. The liquid adhered to the yarn body is thus blown from the yarn and released as a mist 31, which is in turn received by a bore 28 provided in the plug 23 and opposing the slit 20 and discharged from a second conduit 30 through an aperture 29. Thus, the liquid concomitant with the yarn Y withdrawn from the vessel 3 is substantially completely removed, whereby the heat-treatment of the yarn in the hot chamber 6 can be effectively carried out without energy loss and the resultant yarn having uniform properties can be obtained under stable operational conditions. In this connection, the liquid content of the yarn at the yarn exit path of the vessel is preferably not more than 20%, more preferably not more than 10%, relative to the yarn weight.

The liquid 2 is fed to the vessel 3 from the supply pipe 15. Reference numeral 16 designates an overflow pipe inserted into the vessel 3 through an aperture provided in the bottom thereof. The overflow pipe 16 is secured to the bottom of the vessel 3 by tightening a cap 35 while pressing an 0 ring 34 disposed between the bottom of the vessel 3 and the cap 35. This causes the O-ring 34 to be radially deformed, so that the overflow pipe 16 can occupy a predetermined position in the height direction and a liquid-tight seal between the over-flow pipe 16 and the vessel 3 can be achieved. An amount of liquid 17 overflowing from the overflow pipe 16 is discharged from the vessel 3, and thus the depth of the liquid is maintained at a predetermined level defined by the insertion length of the overflow pipe 16. The liquid level in the vessel 3 is easily and infinitely adjustable by unfastening the cap 35 to remove the pressure applied on the 0 ring 34, and then varying the insertion length of the overflow pipe 16.

Reference numeral 33 designates a funnel-like tray for enhancing the guiding of the yarn Y spun from the spinneret 1 to a tubular portion of the sleeve 19 during the threading step at an initial stage of the spinning operation. Further, this tray 33 also has a function of regulating a liquid flow generated by the passage of the yarn and protecting the yarn from unfavorable vibration.

The hot chamber 6 is provided with narrow inlet and outlet paths 7, 7' at the opposite ends thereof sufficiently sealed in a fluid-tight manner to prevent the pressurized steam 13 filled therein from escaping therefrom. If this sealing is insufficient, not only is the energy loss increased due to escape of the pressurized steam 13, but also an air flow concomitant with the yarn is liable to infiltrate the interior of the hot chamber 6 from the inlet path 7, and thus it is difficult to maintain the temperature and the pressure in the hot chamber 6 at a predetermined value. In addition, the escape of the steam 13 causes entanglement of individual filaments composing the yarn Y, which results in an unstable yarn take-up and an inferior, uneven yarn quality.

Figure 5:
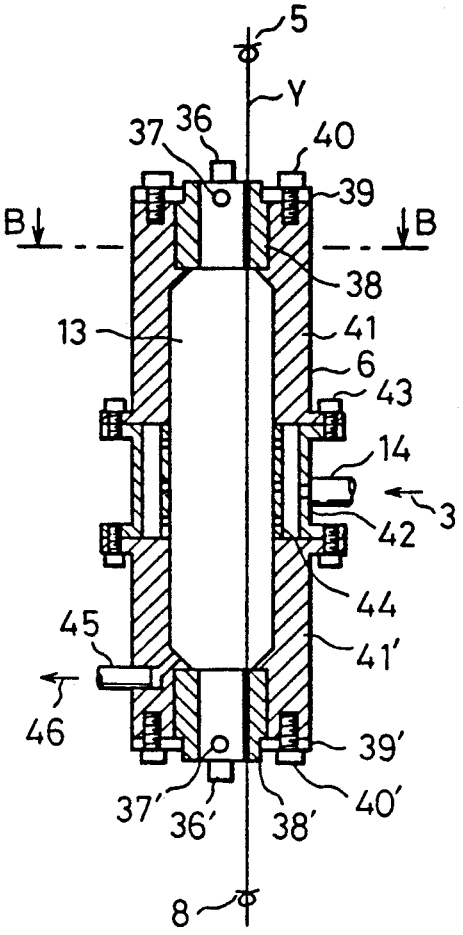
FIG. 5 is a side sectional view of a hot chamber suitably utilized for the process according to the present invention.

FIG. 5 illustrates a side elevational view of the hot chamber utilized for the present invention.

Pressurized steam 13 is supplied into the interior of a housing 42, and the steam 13 is then uniformly distributed in heater tubes 41 and 41' through a filter 44. The heater tubes 41, 41' constitute a hot chamber 6 and are provided with cylindrical sleeves 38, 38', respectively, at the upper end of the former and the lower end of the latter, which sleeves are provided with the respective narrow slit 47 (see FIG. 6) of a size which allows the yarn to pass therethrough, and are inserted into the respective heater tubes 41, 41'. The sleeves 38, 38' are secured in position by the respective flanges 39, 39' and fixed to the heater tubes 41, 41', respectively, by screws 40, 40'. Column-like plugs 36, 36' are detachably inserted into the interior of the sleeves 38, 38', respectively, and fixed to the sleeves 38, 38' by pins 37, 37', respectively, against the pressure of the pressurized steam 13.

A discharge pipe 45 is provided for effectively removing the drain 46 generated, especially at an initial stage of the spinning operation, from the hot chamber 6.

The time required for passage of the yarn Y through the hot chamber is preferably within a range of from 0.0005 seconds to 0.15 seconds.

Figure 6:
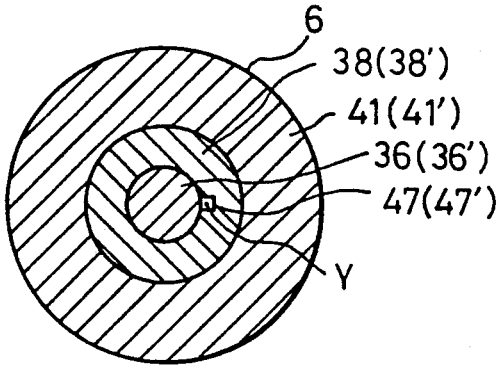
FIG. 6 is a cross-section taken along the line B—B in FIG. 5.

FIG. 6 illustrates a cross-section of the hot chamber 6 taken along the line B—B of FIG. 5. As apparent therefrom, the slit 47 is provided in the inner periphery of the sleeve 38 inserted in the interior of the heater tube 41. The column-like plug 36 is inserted into the interior of the sleeve 38 so that the outer periphery of the plug 36 engages with the inner periphery of the sleeve 38. Thus, the interior of the sleeve 38 is completely sealed by the plug 36, except for the slit 47 having a very small cross-section and forming the inlet path 7. Since the cross-section of the slit 47 is made as small as possible, to allow the passage of the yarn Y alone, the substantial fluid seal of the slit 47 is sufficient due to the pressure loss in the slit zone.

According to the present invention, an initial cooling of the yarn in a zone between the spinneret 1 and the surface of the liquid bath contained in the vessel 3 may be carried out in an environmental atmosphere at a room temperature. However, a spinning conduit 50, such as the conventional cooling chimney and/or spinning duct, is preferably provided around the yarn passage between the spinneret 1 and the liquid surface, to protect the yarn from disturbance of the air flow and apply a regular cooling air flow from one side of the yarn passage. The spinning conduit 50 may be of the conventional type, comprising for example, a hood made of a metal net, steel plate or perforated sheet or a combination thereof.

Next, the threading operation to the liquid vessel 3 and the hot chamber 6 will be explained as follows, with reference to FIGS. 1, 3 and 5.

First, the supply of the liquid 2 to the vessel 3 is stopped by operating a three way valve (not shown) disposed upstream of the liquid supply pipe 15, and the liquid 2 remaining in the interior of the vessel 3 is discharged. The supply of a pressurized air 26 is stopped by closing a valve (not shown) disposed upstream of the first conduit 25, and the supply of the pressurized steam 13 is stopped by operating a three way valve (not shown) disposed upstream of the supply pipe 14 and the steam 13 remaining in the interior of the hot chamber 6 is removed so that the interior of the hot chamber is the atmospheric pressure.

Thereafter, the pins 24, 37, and 37' are withdrawn to remove the plugs 23, 36, and 36' from the sleeves 19, 38, 38', respectively. The yarn suction means such as a suction gun (not shown) is applied to an opening formed by the lowermost sleeve 38' provided at the lower end of the hot chamber 6, so that a suction stream is generated along the yarn path through the hot chamber 6. According to this suction stream, the yarn Y spun from the spinneret 1, passed through the opening of the sleeve 19 of the vessel 3 and arrived at the entrance of the opening of the upper sleeve 38 is withdrawn from the interior of the hot chamber 6 through the opening of the upper sleeve 38 of the hot chamber 6, and finally is drawn into the suction gun through the opening of the lower sleeve 38'. The yarn Y passing through the hot chamber 6 is threaded to the yarn guide 5, 8. Then, after the yarn Y is sequentially engaged in the slits 20, 47, 47' of the sleeves 19, 38, 38', the plugs 23, 36 and 36' are fitted to the sleeves 19, 38, 38', respectively, and fixed by the pins 24, 37, 37'. Thereafter, the pressurized air 26 is supplied to the first conduit 25, and the liquid 2 and the pressurized steam 13 are also supplied to the vessel 3 and the hot chamber 6, respectively. The yarn Y is then taken up through the rollers 10, 11 on the winder 12. The threading operation in the system shown in FIG. 2 will be easily understood with reference to the above description of the threading operation in the system shown in FIG. 1.

At an initial stage, a temperature of the interior of the hot chamber 6 is still at a low level, which tends to generate a large amount of drain in the hot chamber 6. In this case, the drain may be discharged therefrom by adjusting the opening of a valve (not shown) disposed downstream of the discharging pipe 45.

As stated above, the threading operation is carried out while no liquid is in the vessel 3. Under these circumstances, the yarn cannot be sufficiently cooled and adhesion and breakage of the individual filaments is liable to occur. To enhance the, cooling of the yarn and avoid these problems, the amount of molten polymer discharged from the spinneret may be decreased for a while during the threading operation. Alternatively, cooling air may be applied to the as-spun yarn to forcibly cool the same. Further, the vessel 3 may be adapted to be capable of displacing downward relative to the spinneret and occupy the lower position only during the threading operation so that the length of a cooling zone becomes larger. To achieve the same purpose, a small quantity of liquid may be imparted to the yarn just before the yarn enters the slit 20 of the sleeve 19.

The fiber-forming thermoplastic polymer utilized for the present invention includes polyamide, such as poly-e-capramide, polyhexamethylene adipamide, polyhexamethylene cebacamide, polytetramethylene adipamide, polyhexamethylene isophthalamide, polydodecamethylene dodecamide, polymetaxylene adipamide, or polyparaxylene adipamide; polyesters, such as polyethyleneterephthalate, polymethylene terephthalate, polyethylene 1,2-diphenolethane PP'-dicarboxylate, or polynaphthaleneterephthalate; polyolefin, such as polyethylene, polypropylene, or polybutene-1; copolymers of polyfluoroethylene-polyfluorovinylidene, polyvinylchloride, polyvinylidenechloride, polyacetal and copolymer and mixed polymers composed of more than two kinds thereof.

Most preferably, the polymer used for the present invention is a polyester.

The liquid utilized for the present invention may be water, an organic solvent, an inorganic salt, oil or an aqueous solution thereof. Water is most preferable.

The liquid, the liquid depth, the length of the cooling zone between the spinneret and the liquid surface should be selected in accordance with the spinning conditions such as yarn thickness, yarn temperature, take-up speed, and environmental temperature, so that the yarn is not excessively cooled and drawn in the liquid bath, and the yarn can be solidified by the time the yarn reaches the yarn exit path provided in the bottom of the vessel.

The variance of the liquid temperature is preferably as small as possible so that the quality difference of the yarn obtained from one spinning unit or the respective spinning units is suppressed. An allowable temperature range is preferably $\pm 10°$ C., more preferably $\pm 5°$ C.

The pressure of the steam in the hot chamber is preferably not less than 0.5 $kg/cm^2G$, more preferably in a range of from 1.0 $kg/cm^2G$ to 3.0 $kg/cm^2G$. In this connection, atmospheric pressure corresponds to 0 $kg/cm^2G$. The length of the hot chamber is preferably in a range of from 5 cm to 100 cm. The cross-section the inlet and outlet paths of the hot chamber along a plane perpendicular to the longitudinal axis of the hot chamber is preferably not more than 4.0 $mm^2$, more preferably in a range of from 0.01 $mm^2$ to 4.0 $mm^2$.

The steam supplied to the hot chamber is preferably saturated. Unsaturated steam, however, may be utilized to minimize the generation of drain midway in a steam supply tube.

The yarn take-up speed is preferably not less than 2500 m/min so that the yarn quality is further improved. In view of the operational stability and ease of the threading operation, the yarn take-up speed is preferably in a range of from 3000 m/min to 6000 m/min.

Note that the sealing of the vessel and the hot chamber is not limited to the illustrated designs but other conventional means can be also adopted as an alternative.

The effect of the present invention will be more apparent from the following examples:

EXAMPLE 1

A spinning test was carried out by means of an apparatus shown in FIG. 1 with polyethyleneterephthalate chips having an intrinsic viscosity $[\eta]=0.63$. The fixed spinning conditions were as follows:

Room temperature: 15° C.
Spinning temperature: 295° C.
Spinneret:
  Dia. of orifice=0.5 mm,
  Number of orifice=2
Discharge rate: 26.7 g/min
Distance between spinneret and liquid surface: 1400 mm
Hot chamber:
  Length=40 cm
  Inner dia.=60 mm
  Slit width=0.2 mm
  Slit depth=0.2 mm
  Slit length=30 mm Pressurized steam was introduced into the hot chamber through an annular filter having a mesh size of 100μ, a pressure of which was changed at various levels.

The dimensions of a slit of a yarn exit provided at the bottom of the vessel were 0.2 mm width, 0.5 mm depth, and 30 mm length. Pressurized air of 0.5 kg/cm$^2$G was ejected transversely to the slit for removing the liquid concomitant with the yarn so that the liquid content of the yarn was approximately 7% relative to the yarn weight.

Water was utilized as the liquid bath, the temperature of which was adjusted by a heater provided in the supply tube at various levels. Also, the depth of the liquid bath was changed at various levels The yarn discharged from the liquid bath was heat-treated and drawn in the hot chamber, and after being oiled, taken up at a speed of 4000 m/min as a drawn yarn comprising two filaments having 60 denier in total.

A comparative test was conducted in the same manner as before, except for elimination of the hot chamber shown in FIG. 1.

Another comparative test was conducted in the same manner as Example 1, except for elimination of the liquid bath shown in FIG. 1. In this connection, the distance between the spinneret and the hot chamber was 4900 mm, to compensate for the insufficient cooling of the yarn due to elimination of the liquid bath.

The characteristics of the resultant yarns obtained by the above respective test runs are listed in Table 1. It will be apparent from the Table that the yarn obtained by run Nos. 1 through 5 according to the present invention are superior, in mechanical properties, to those obtained by run Nos. 6-1 through 6-3 according to the comparative test. That is, the yarn according to the present invention has a greater strength and a smaller elongation as well as a lower shrinkage rate in boiling water. Thus, the yarns obtained from the present invention were applicable for practical use without further treatment.

In a comparison of run No. 1 with run No. 2, it was found that the depth of the liquid bath affects the mechanical properties of the resultant yarn. This is because the cooling efficiency is improved when the depth of the liquid bath is increased from 40 mm to 80 mm.

Regarding the pressure of the steam supplied to the hot chamber, as shown in run Nos. 2, 3 and 4, the drawability of the yarn is improved as the pressure is elevated, namely, the strength becomes greater and the elongation becomes less. A higher steam pressure such as 3 kg/cm$^2$G is, however, unfavorable, because of a significant drop in the elongation.

In the Table, a primary modulus is defined by a maximum inclination of a stress-strain curve of the yarn in a zone of elongation of 0% through 2%, while a 5% elongation modulus is defined by an inclination of a straight line connecting a point on the stress-strain curve corresponding to an elongation of 5% and the origin of the curve.

TABLE 1

| | Liquid Bath | | Hot Chamber | Yarn Characteristics | | | | |
|---|---|---|---|---|---|---|---|---|
| Run No. | Temp. (°C.) | Depth (mm) | Steam Pressure (kg/cm$^2$G) | Strength (g/d) | Elongation (%) | Shrinkage in B.W. (%) | Primary Modulus (g/d) | 5% Elongation Modulus (g/d) |
| 1 | 15 | 40 | 1 | 2.9 | 36 | 4.6 | 64 | 29 |
| 2 | 15 | 80 | 1 | 3.7 | 54 | 6.9 | 80 | 34 |
| 3 | 15 | 80 | 2 | 4.0 | 43 | 5.0 | 82 | 41 |
| 4 | 15 | 80 | 3 | 4.3 | 29 | 5.3 | 105 | 51 |
| 5 | 80 | 80 | 1 | 3.0 | 36 | 7.9 | 105 | 31 |
| 6-1* | 15 | 80 | — | 2.1 | 110 | 51.6 | 36 | 14 |
| 6-2* | — | — | 1 | 3.3 | 48 | 7.5 | 59 | 26 |
| 6-3* | — | — | 1.5 | 3.6 | 54 | 5.4 | 82 | 26 |

*Comparative test

EXAMPLE 2

A spinning test was carried out by means of an apparatus shown in FIG. 1 with polycapramide chips having a viscosity relative to sulfuric acid $[\eta_{65}]=2.6$ under conditions of a spinning temperature of 265° C. and a room temperature of 15° C. The resultant yarn was taken up at a speed of 4000 m/min as a drawn yarn comprising two filaments having 60 denier in total. Other conditions were the same as in Example 1.

A comparative test was conducted in the same manner as before, except for elimination of the hot chamber shown in FIG. 1.

The characteristics of the resultant yarns obtained by the respective runs are listed in Table 2.

As apparent from a comparison of run Nos. 7 through 11 according to the present invention, with run No. 12 according to the comparative test, the yarns obtained from the present invention were superior to these from the comparative test, in mechanical properties.

The yarn obtained from run No. 10 had a greater strength compared to that from run No. 12, in which the depth of the liquid bath was 80 mm and 180 mm, respectively, for the same reason as given in Example 1. In the case of a 280 mm depth, however, the yarn strength was as same as for a 180 mm depth, which shows that a liquid depth of 180 mm is sufficient for purposes of the present invention.

For the pressure level of the steam in the hot chamber, results similar to Example 1 were obtained.

TABLE 2

| | Liquid Bath | | Hot Chamber | Yarn Characteristics | | |
|---|---|---|---|---|---|---|
| Run No. | Temp. (°C.) | Depth (mm) | Steam Pressure (kg/cm$^2$G) | Strength (g/d) | Elongation (%) | Shrinkage in B.W. (%) |
| 7 | 15 | 80 | 1 | 4.2 | 50 | 12.2 |
| 8 | 15 | 80 | 2 | 4.4 | 51 | 12.1 |
| 9 | 15 | 80 | 3 | 3.8 | 45 | 10.8 |
| 10 | 15 | 180 | 2 | 4.7 | 49 | 13.1 |
| 11 | 80 | 280 | 2 | 4.7 | 41 | 13.1 |
| 12* | 15 | 80 | — | 2.4 | 69 | 6.3 |

*Comparative test

EXAMPLE 3

A spinning test was carried out by means of an apparatus shown in FIG. 1 with polyethyleneterephthalate chips having an intrinsic viscosity $[\eta]=0.63$. The fixed spinning conditions were as follows:

Room temperature: 15° C.
Spinning temperature: 295° C.
Spinneret:
Dia. of orifice=0.15 mm,
Number of orifices=34
Discharging rate of Polymer: 15.0 g/min The other conditions were the same as in Example 1, and the resultant yarn was taken up at a speed of 4000 m/min as a drawn yarn comprising 34 filaments having 34 denier in total.

A comparative test was conducted by means of modifications of the spinning apparatus shown in FIG. 1, in which either or both of the liquid bath and the hot chamber were eliminated.

The characteristics of the resultant yarns obtained by the respective runs are listed in Table 3.

As apparent from a comparison of run Nos. 13 through 17 according to the present invention, with run Nos. 18 through 20 according to comparative test, the yarns obtained from the present invention were superior to those from the latter, in mechanical properties.

It should be noted that, when the depth of the liquid bath was 80 mm, the elongation of the resultant yarn was lower than that of the yarn obtained at a 40 mm depth. Therefore, the depth of the liquid bath is preferably 40 mm.

TABLE 3

| | Liquid Bath | | Hot Chamber | Yarn Characteristics | | |
|---|---|---|---|---|---|---|
| Run No. | Temp. (°C.) | Depth (mm) | Steam Pressure (kg/cm²G) | Strength (g/d) | Elongation (%) | Shrinkage in B.W. (%) |
| 13 | 80 | 40 | 1 | 4.2 | 27 | 8.7 |
| 14 | 80 | 40 | 2 | 4.4 | 23 | 6.5 |
| 15 | 80 | 40 | 3 | 4.5 | 23 | 5.3 |
| 16 | 80 | 80 | 1 | 4.4 | 18 | 9.6 |
| 17 | 15 | 40 | 1 | 4.6 | 32 | 9.9 |
| 18* | 80 | 40 | — | 3.5 | 41 | 64.4 |
| 19* | — | — | 1 | 4.0 | 33 | 9.0 |
| 20* | — | — | — | 3.5 | 82 | 11.5 |

*Comparative test

EXAMPLE 4

A spinning test according to the present invention was conducted under conditions similar to those of Example 1, except for varying the discharging rate of polymer spun from the spinneret and the take-up speed of the resultant yarn so that a drawn yarn of 60 d/2 f (a thickness of an individual filament composing the yarn is 30 denier) was obtained. Also, a comparative test similar to run Nos. 6-2 and 6-3 of Example 1 was conducted.

The characteristics of the resultant yarn obtained from the respective runs are listed in Table 4.

TABLE 4

| | | | | | Yarn Characteristics | | | |
|---|---|---|---|---|---|---|---|---|
| | Take-up | Liquid Bath | | Hot Chamber | | | Primary | 5% Elongation |
| Run No. | Speed (m/min) | Temp. (°C.) | Depth (mm) | Steam Pressure (kg/cm²G) | Strength (g/d) | Elongation (%) | Modulus (g/d) | Modulus (g/d) |
| 21 | 3500 | 15 | 80 | 1 | 4.0 | 52 | 106 | 34 |
| 22 | 3500 | 15 | 80 | 2 | 4.9 | 39 | 131 | 51 |
| 23 | 4500 | 15 | 80 | 1 | 4.1 | 41 | 118 | 40 |
| 24 | 4500 | 15 | 80 | 2 | 4.1 | 39 | 121 | 41 |
| 25* | 3500 | — | — | 1 | 3.7 | 64 | 75 | 24 |
| 26* | 4500 | — | — | 1 | 3.3 | 45 | 78 | 27 |

*Comparative test

EXAMPLE 5

A spinning test according to the present invention was conducted under conditions similar to those of Example 1, except for varying the discharging rate of polymer spun from the spinneret so that a drawn yarn of 40 d/2 f (a thickness of an individual filament composing the yarn was 20 denier) was obtained. Also, a comparative test similar to run Nos. 6-2 and 6-3 of Example 1 was conducted.

The characteristics of the resultant yarn obtained from the respective runs are listed in Table 5.

TABLE 5

| | | | | | Yarn Characteristics | | | |
|---|---|---|---|---|---|---|---|---|
| | Take-up | Liquid Bath | | Hot Chamber | | | Primary | 5% Elongation |
| Run No. | Speed (m/min) | Temp. (°C.) | Depth (mm) | Steam Pressure (kg/cm²G) | Strength (g/d) | Elongation (%) | Modulus (g/d) | Modulus (g/d) |
| 27 | 4000 | 15 | 80 | 1 | 4.1 | 49 | 116 | 37 |
| 28 | 4000 | 15 | 80 | 2 | 4.3 | 49 | 124 | 37 |
| 29 | 4000 | 15 | 80 | 2.7 | 4.4 | 34 | 161 | 48 |
| 30 | 4000 | 15 | 40 | 1 | 4.3 | 58 | 115 | 38 |
| 31* | 4000 | — | — | 1 | 3.8 | 49 | 89 | 28 |
| 32* | 4000 | — | — | 2 | 4.0 | 44 | 103 | 35 |
| 33* | 4000 | — | — | 3 | 4.2 | 42 | 118 | 38 |

*Comparative test

EXAMPLE 6

A spinning test according to the present invention was conducted under conditions similar to those of Example 1, except for varying the discharging rate of polymer spun from the spinneret so that a drawn yarn of 20 d/2 f (a thickness of an individual filament composing the yarn was 10 denier) was obtained Also, a comparative test similar to run Nos. 6-2 and 6-3 of Example 1 was conducted.

The characteristics of the resultant yarn obtained from the respective runs are listed in Table 6.

TABLE 6

| Run No. | Take-up Speed (m/min) | Liquid Bath Temp. (°C.) | Liquid Bath Depth (mm) | Hot Chamber Steam Pressure (kg/cm²G) | Yarn Characteristics Strength (g/d) | Elongation (%) | Primary Modulus (g/d) | 5% Elongation Modulus (g/d) |
|---|---|---|---|---|---|---|---|---|
| 34 | 4000 | 15 | 80 | 1 | 4.1 | 31 | 128 | 43 |
| 35 | 4000 | 15 | 80 | 2 | 4.2 | 30 | 162 | 48 |
| 36 | 4000 | 15 | 80 | 2.7 | 4.4 | 29 | 163 | 52 |
| 37 | 4000 | 15 | 40 | 1 | 3.9 | 34 | 117 | 41 |
| 38* | 4000 | — | — | 1 | 3.9 | 36 | 155 | 37 |
| 39* | 4000 | — | — | 2 | 4.2 | 32 | 150 | 44 |
| 40* | 4000 | — | — | 3 | 4.0 | 29 | 123 | 44 |

*Comparative test

We claim:

1. A method for producing a thermoplastic synthetic yarn comprising the steps of continuously downwardly extruding a fiber-forming thermoplastic polymer in molten state from a spinneret to form a filament yarn, passing the as-spun yarn through a liquid cooling bath disposed beneath the spinneret and thence through a hot chamber filled with pressurized steam, the yarn being drawn at least during its passage through the hot chamber, wherein (a) the liquid bath has a restricted yarn exit path therein, which yarn exit path is provided with an aperture connected to a first conduit for injecting pressurized air transversely to the yarn exit path and another aperture connected to a second conduit for receiving and exhausting the air injected from the first conduit which is mixed with a mist released from the running yarn, (b) the hot chamber is provided with narrow inlet and outlet paths having a size allowing the yarn to pass through but substantially preventing the pressurized steam from escaping from the chamber, (c) the water content of the cooled yarn prior to introduction to the hot chamber is not more than 20% relative to the yarn weight, and (d) a yarn take-up speed at a stage downstream of the hot chamber is from 2500 m/min to 6000 m/min.

2. A method for producing a thermoplastic synthetic yarn as defined in claim 1, wherein a drawing of the yarn is started in said liquid bath.

3. A method for producing a thermoplastic yarn as defined in claim 1, wherein said liquid bath is a water bath.

4. A method for producing a thermoplastic yarn as defined in claim 3, wherein a temperature of said water bath is in a range of from 5° C. to 90° C.

5. A method for producing a thermoplastic yarn as defined in claim 4, wherein a time required for the yarn to pass said water bath is in a range of from 0.001 sec to 0.15 sec.

6. A method for producing a thermoplastic yarn as defined in claim 3, wherein a water content of said cooled yarn prior to introduction to said hot chamber is not more than 10% relative to a yarn weight.

7. A method for producing a thermoplastic yarn as defined in claim 1, wherein said pressurized steam filled in the hot chamber is a saturated steam.

8. A method for producing a thermoplastic yarn as defined in claim 7, wherein a pressure of said saturated steam is not less than 0.5 kg/cm² G.

9. A method for producing a thermoplastic yarn as defined in claim 8, wherein a pressure of said saturated steam is in a range of from 1.0 kg/cm² G to 3.0 kg/cm² G.

10. A method for producing a thermoplastic yarn as defined in claim 9, wherein a time required for the yarn to pass said hot chamber is in a range of from 0.0005 sec to 0.15 sec.

11. A method for producing a thermoplastic yarn as defined in claim 1, wherein a yarn take-up speed at a stage downstream of the hot chamber is in a range of from 3000 m/min to 6000 m/min.

12. A method for producing a thermoplastic yarn as defined in claim 1, wherein a cross-section of said path of the hot chamber along a plane perpendicular to the longitudinal axis of the hot chamber is not more than 4.0 mm².

13. A method for producing a thermoplastic synthetic yarn as defined in claim 1, wherein a cross-section of said path of the hot chamber along a plane perpendicular to the longitudinal axis of the hot chamber is in a range of from 0.01 mm² to 4.0 mm².

14. A method for producing a thermoplastic yarn as defined in claim 1, wherein a thickness of an individual filament composing said yarn at a stage downstream of the hot chamber is not less than 25 denier.

15. A method for producing a thermoplastic yarn as defined in claim 14, wherein a thickness of an individual filament composing said yarn at a stage downstream of the hot chamber is in a range of from 25 denier to 250 denier.

* * * * *